US005445130A

United States Patent [19]

Brümmer et al.

[11] Patent Number: 5,445,130

[45] Date of Patent: Aug. 29, 1995

[54] FUEL DISTRIBUTOR FOR A MULTI-CYLINDER INTERNAL COMBUSTION ENGINE

[75] Inventors: Michael Brümmer, Laudenbach; Antonio Vitiello, Waldmichelbach; Volker Daume, Hirschorn, all of Germany

[73] Assignee: Firma Carl Freudenberg, Weinheim, Germany

[21] Appl. No.: 215,349

[22] Filed: Mar. 21, 1994

[51] Int. Cl.[6] ..... F02M 41/00

[52] U.S. Cl. ..... 123/456; 123/470

[58] Field of Search ..... 123/456, 470, 469, 468, 123/447, 472

[56] References Cited

U.S. PATENT DOCUMENTS

| | | | |
|---|---|---|---|
| 4,457,280 | 7/1984 | Hudson | 123/470 |
| 4,922,958 | 5/1990 | Lemp | 123/456 |
| 5,002,030 | 3/1991 | Mahnke | 123/456 |
| 5,088,463 | 2/1992 | Afteldt | 123/456 |
| 5,092,300 | 3/1992 | Omoehl | 123/469 |
| 5,094,211 | 7/1992 | Mahnke | 123/456 |
| 5,197,436 | 3/1993 | Ozawa | 123/456 |
| 5,233,963 | 8/1993 | Gregorius et al. | 123/456 |

FOREIGN PATENT DOCUMENTS 3239361 10/1988 Japan ..... 123/456

*Primary Examiner*—Carl S. Miller

*Attorney, Agent, or Firm*—Kenyon & Kenyon

[57] ABSTRACT

A fuel distributor for a multi-cylinder combustion engine with fuel-injection system, comprising a fuel flow divider having a tubular distributor housing and at least one fuel feed connection as well as at least one fuel return connection. The fuel flow divider has a number of first receiving holes which corresponds to the number of injection valves, and a second receiving hole arranged in the region of an end limitation of the distributor housing. In order to supply fuel to an internal combustion engine having at least two rows of cylinders, one fuel flow divider is used for each row of cylinders, the fuel flow dividers being developed in corresponding manner and being connected to each other in fuel-conducting manner by a connecting line and arranged in series. A pressure regulating valve is arranged in said second receiving hole of one of the two fuel flow dividers and a pressure test connection is arranged in said second receiving hole of the other fuel flow divider.

8 Claims, 3 Drawing Sheets

FUEL DISTRIBUTOR FOR A MULTI-CYLINDER INTERNAL COMBUSTION ENGINE

BACKGROUND OF THE INVENTION

The present invention relates generally to a fuel distributor for a multi-cylinder internal combustion engine having a fuel-injection system. The fuel distributor comprises a fuel flow divider having a tubular distributor housing and at least one fuel feed connection as well as at least one fuel return connection. The fuel flow divider has a number of first receiving holes which corresponds to the number of injection valves, and a second receiving hole arranged in the region of an end limitation of the distributor housing.

Such a fuel distributor is known from German Patent OS 41 11 988, which corresponds to U.S. Pat. No. 5,233,963 (the contents of which are incorporated herein by reference). This known fuel flow divider is intended for use with internal combustion engines, the cylinders of which are arranged in a row with respect to each other. This reference provides no indication whether or how such a fuel flow divider could be used in internal-combustion engines of the type having at least two rows of cylinders.

There remains a need for the-further development of a fuel distributor of the aforementioned type that can be used in internal-combustion engines which have at least two rows of cylinders, and in such a manner that its construction is both simple and economical.

SUMMARY OF THE INVENTION

The present invention provides a linked set of fuel flow dividers. Each divider includes a tubular distributor housing, a fuel feed connection to serve as a fuel inlet to the first fuel flow divider, a fuel return connection to act as a fuel outlet to the first fuel flow divider, as many of first receiving holes as there are cylinders, and a second receiving hole arranged in the region of an end portion of the distributor housing.

Within the scope of the present invention, one fuel flow divider is used for each row of cylinders for supplying fuel to an internal combustion engine having at least two rows of cylinders. The fuel flow dividers are of identical development and are in fuel-communicating connection with each other by a connecting line and are arranged in series. A pressure regulating valve is arranged in said second receiving hole of one of the two fuel flow dividers and a pressure test connection is located at the second receiving hole of the other fuel flow divider. Such an arrangement of fuel flow dividers is particularly advantageous when the two rows of cylinders form an angle with each other of more than 60°. When two fuel flow dividers which are in fuel flowing communication with each other are used, it is advantageous for the two parts to be completely identical. With regard to manufacture, it is substantially more favorable to produce only one fuel flow divider, which can then be used in duplicate for supplying fuel to the internal combustion engine. The use of identical parts is possible due to the fact that the receivers for the pressure regulator and pressure test connection employed are of corresponding development, and the design of the specially developed pressure test connection permits the flow of plastic. In addition to the advantage that only one injection mold is necessary in order to produce the identical fuel flow dividers, the use of two identical fuel flow dividers is also advantageous from a logistic standpoint and in the event of repair. The maintaining of stocks is substantially simplified by this aspect of the invention.

The development of the fuel flow divider with its first and second receiving holes can be effected more easily if a polymer material is used for its production and the fuel flow dividers are produced by injection molding. In addition to the simplified manufacture as compared with fuel flow dividers consisting of a metallic material, the reduction in weight is of definite importance. In accordance with one aspect of the invention, the fuel flow dividers may be manufactured using a polymer material that is resistant to fuel and heat.

The fuel flow dividers are constructed so that they are serially traversed by fuel from the feed connection to the direction of the return connection. The pressure regulating valve and the pressure test connection have corresponding connecting regions for mounting in the fuel flow divider, the pressure test connection being arranged in said second receiving hole of the first fuel flow divider in the direction of fuel flow, and the pressure regulating valve being connected in a liquid-tight manner in said second receiving hole of the second fuel flow divider. In connection with the arrangement of the pressure regulating valve, it is noted that all injection valves can be controlled via pressure regulation. Consequently, the pressure test connection must be arranged in the region between the fuel inlet feed connection and the pressure regulating valve in the direction of fuel flow. The pressure test connection is provided in order to provide a means for sensing (which may then be displayed) any deviations of pressure within the fuel distributor that exceed a given threshold value. The pressure test connection is therefore necessary for the search for faults.

BRIEF DESCRIPTION OF THE DRAWINGS

One embodiment of the fuel distributor of the invention is shown diagrammatically in the drawings and will be described in further detail below.

DETAILED DESCRIPTION

Figure 1:
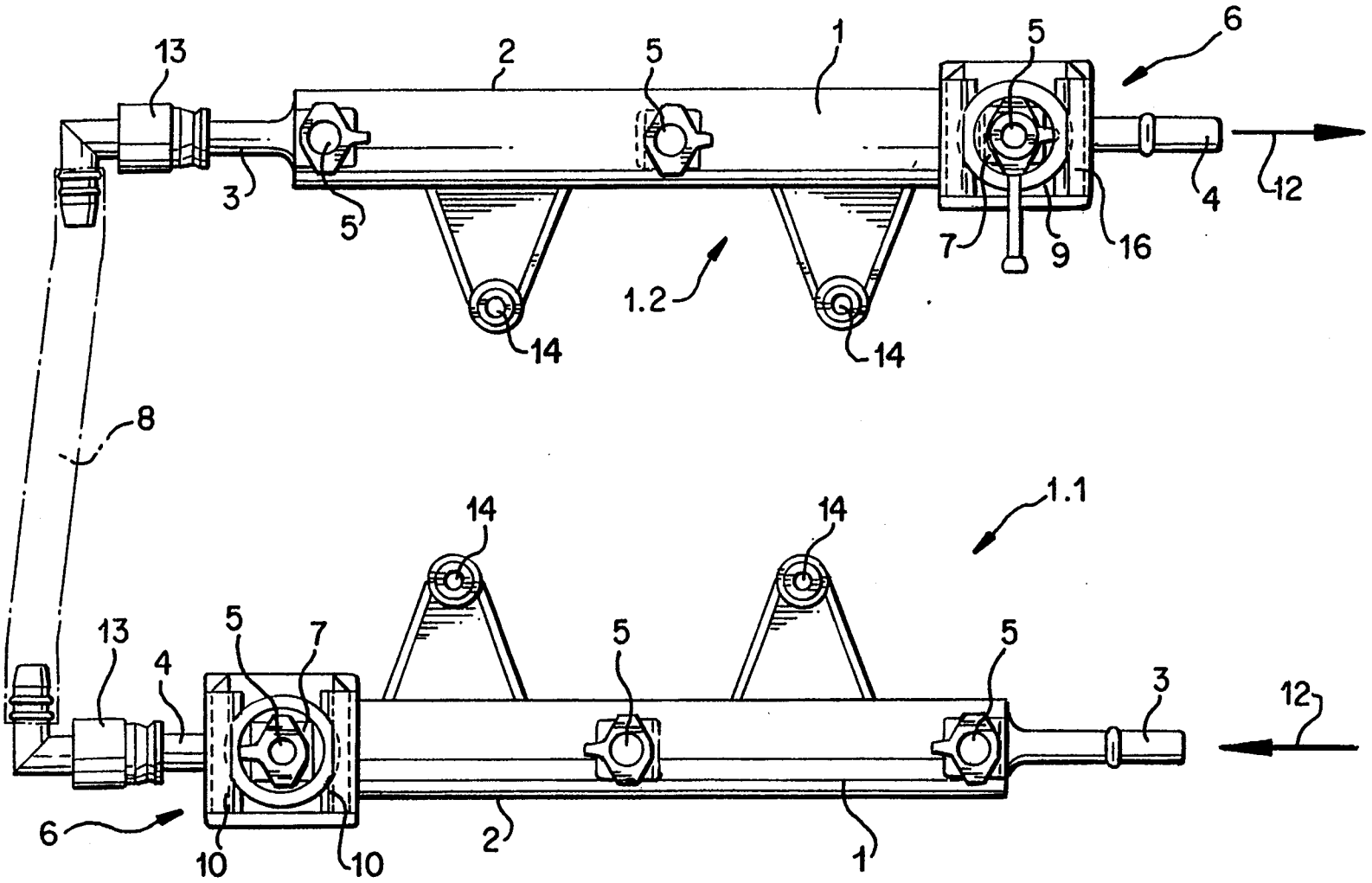
FIG. 1 provides a top, diagrammatical view of two identical fuel flow dividers in fuel communication with each other via a connecting line having two connecting flanges.

FIG. 1 shows a portion of a fuel distributor system that is used to feed fuel to an internal combustion engine (not shown) having two rows of cylinders, e.g., a V-6 engine having rows of cylinders offset with respect to each other at an angle of 90°. While shown for use with a V-6 engine, both the number of cylinders and the size of the angle between the cylinders may vary depending on the circumstances of the specific case of use. The scope of the instant invention encompasses such variants.

Each of the fuel flow dividers 1.1 and 1.2 is provided with a tubular distributor housing 2, each of the fuel flow dividers 1 having a fuel feed inlet connection 3 and a fuel return outlet connection 4. Injection valves (not separately shown) are contained in the first receiving holes 5 during use of the dividers. In order to regulate the pressure within the fuel system, a pressure regulating valve 9 is arranged in the region of the end limitation 6 of the second distributor housing 2 (viewed in the direction of flow 12). The fuel return connection 4 of the first fuel flow divider 1.1 is connected through connecting flanges 13 to the fuel feed connection 3 of the second fuel flow divider via a connecting conduit 8 (shown in dash-dot lines in FIG. 1). Holding arms 14 (FIG. 1), integral with the fuel flow divider 1, are also provided, and have attachment holes for attaching the fuel flow dividers 1 to the cylinder head of the internal combustion engine.

Figure 2:
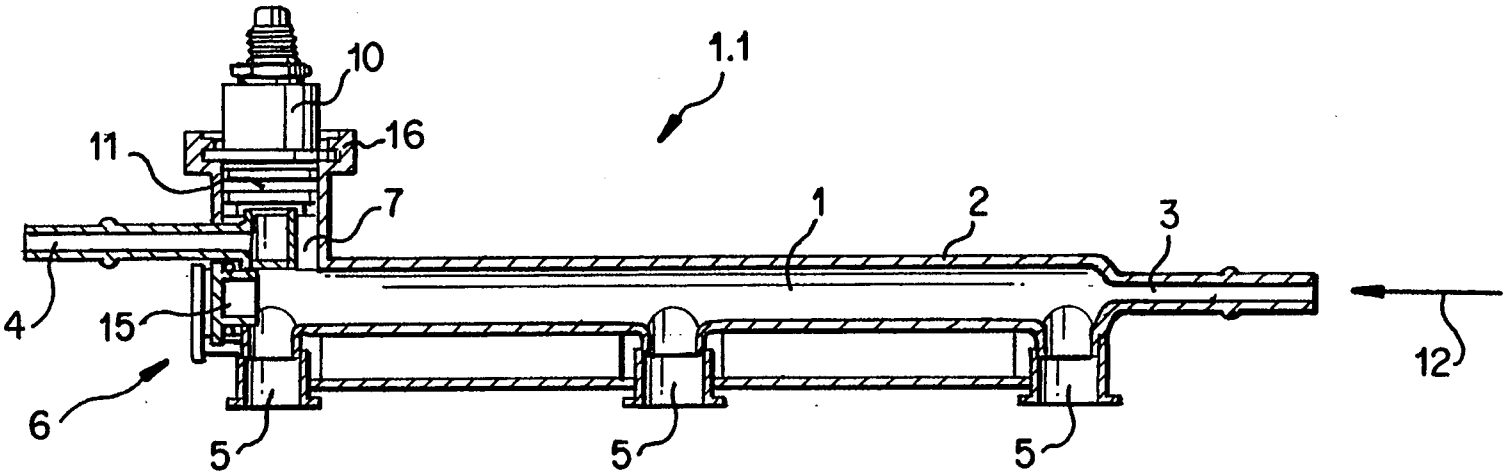
FIG. 2 shows a longitudinal section through the fuel flow divider that is arranged first with respect to the direction of fuel flow.

FIG. 2 is a longitudinal section through the first fuel flow divider 1.1 of FIG. 1. The first receiving holes 5 for the attachment of the injection valves adjoin the fuel feed connection 3 in the direction of flow 12. The fuel flow divider 1 is sealingly closed by a cover 15 on the side opposite the fuel feed connection 3. Before the fuel leaves the first fuel flow divider 1.1 through the fuel-return connection 4, it passes the second receiving hole 7 into which a pressure test connection is inserted. The connecting region 11 of the pressure test connection 10 is of substantially the same development as the connecting region 11 of the pressure regulating valve 9 and is arranged in sealing fashion within said second receiving hole 7. The second fuel flow divider 1.2 of FIG. 3 does not differ from the fuel flow divider 1.1 of FIG. 2. However, instead of the pressure test connection 10 of FIG. 2 being arranged in said second receiving hole 7, there is instead arranged therein a pressure regulating valve 9 that with respect to the direction of flow 12, in front of the fuel return connection 4.

Figure 3:
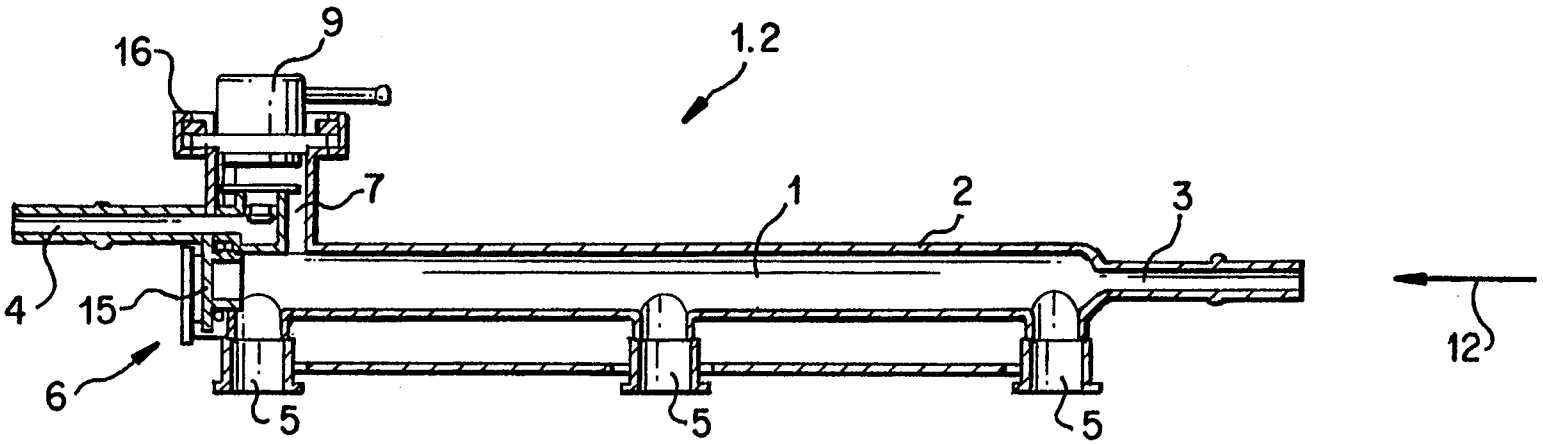
FIG. 3 shows a longitudinal section through the second fuel flow divider that is downstream of the first fuel flow divider.

As seen in FIGS. 2 and 3, both the pressure regulating valve 9 and the pressure test connection 10 are held by separate clamps 16 in said second receiving hole of the fuel flow dividers 1.

What is claimed is:

1. A fuel distributor for a multi-cylinder internal combustion engine of the type having at least two rows of cylinders and further having a fuel-injection system that includes injection valves, the fuel distributor comprising:

a first fuel flow divider for supplying fuel to a first row of engine cylinders, said fuel flow divider comprising a tubular distributor housing;

at least one fuel feed connection to serve as a fuel inlet to the first fuel flow divider;

at least one fuel return connection to serve as a fuel outlet to the first fuel flow divider;

a number of first receiving holes which corresponds to the number of injection valves that are serviced by the first fuel flow divider; and a second receiving hole arranged in the region of a terminal portion of the distributor housing;

a second fuel flow divider for supplying fuel to a second row of engine cylinders, said fuel flow divider comprising a tubular distributor housing;

at least one fuel feed connection to serve as a fuel inlet to the second fuel flow divider;

at least one fuel return connection to serve as a fuel outlet to the second flow divider;

a number of first receiving holes which corresponds to the number of injection valves that are serviced by the second fuel flow divider; and a second receiving hole arranged in the region of a terminal portion of the distributor housing;

a pressure regulating valve that is attached to the second receiving hole of one of the distributor housings;

a pressure test connection with the second receiving hole of one of the distributor housings; and a connecting line serially linking the first and second flow dividers to one another so that fuel can flow via the connecting line from one flow divider to the other flow divider, wherein the second receiving holes of each fuel flow divider are identically formed to thereby accommodate either a pressure test connection or a pressure regulatory valve.

2. A fuel distributor according to claim 1, wherein the fuel flow dividers are made of a polymeric material that is resistant to fuel and heat.

3. A fuel distributor according to claim 1, wherein fuel serially flows through the fuel flow dividers from the fuel feed connection in the direction of the fuel return connection of each divider.

4. A fuel distributor according to claim 2, wherein fuel serially flows through the fuel flow dividers from the fuel feed connection in the direction of the fuel return connection of each divider.

5. A fuel distributor according to claim 1, wherein:

the pressure regulating valve and the pressure test connection have corresponding connecting regions for mounting in the fuel flow dividers;

the pressure test connection is arranged in said second receiving hole of the first fuel flow divider as viewed in the direction of fuel flow; and the pressure regulating valve is arranged in liquid-tight manner in said second receiving hole of the second fuel flow divider.

6. A fuel distributor according to claim 2, wherein:

the pressure regulating valve and the pressure test connection have corresponding connecting regions for mounting in the fuel flow dividers;

the pressure test connection is arranged in said second receiving hole of the first fuel flow divider as viewed in the direction of fuel flow; and the pressure regulating valve is arranged in liquid-tight manner in said second receiving hole of the second fuel flow divider.

7. A fuel distributor according to claim 3, wherein:

the pressure regulating valve and the pressure test connection have corresponding connecting regions for mounting in the fuel flow dividers;

the pressure test connection is arranged in said second receiving hole of the first fuel flow divider as viewed in the direction of fuel flow; and the pressure regulating valve is arranged in liquid-tight manner in said second receiving hole of the second fuel flow divider.

8. A fuel distributor for a multi-cylinder internal combustion engine of the type having at least two rows of cylinders, the fuel distributor comprising:

a plurality of fuel injectors, each having an injection valve;

a first and second fuel flow dividers for supplying fuel to a first row of engine cylinders, said fuel flow dividers comprising a tubular distributor housing;

at least one fuel feed connection to serve as a fuel inlet to the first fuel flow divider;

at least one fuel return connection to serve as a fuel outlet to the first fuel flow divider;

a number of first receiving holes which corresponds to the number of injection valves that are serviced by the first fuel flow divider; and a second receiving hole arranged in the region of a terminal portion of the distributor housing;

a pressure regulating valve that is attached to the second receiving hole of one of the distributor housings;

a pressure test connection with the second receiving hole of one of the distributor housings, wherein the second receiving hole of both the first and second fuel flow dividers are identically formed to thereby accommodate either a pressure test connection or a pressure regulating valve; and a connecting line serially linking the first and second flow dividers to one another so that fuel can flow via the connecting line from one flow divider to the other flow divider.

* * * * *